United States Patent [19]

Davis et al.

[11] Patent Number: 4,912,904

[45] Date of Patent: Apr. 3, 1990

[54] COCKTAIL FILLING APPARATUS

[75] Inventors: Walter F. Davis, Denair; Wayne D. Rickey, Turlock, both of Calif.

[73] Assignees: Tri/Valley Growers, San Francisco; P & F Machine, Turlock, both of Calif.

[21] Appl. No.: 210,822

[22] Filed: Jun. 24, 1988

[51] Int. Cl.[4] ..... B65B 1/10; B65B 39/14

[52] U.S. Cl. ..... 53/155; 53/237; 53/247; 53/251; 221/265

[58] Field of Search ..... 53/155, 237, 238, 239, 53/240, 247, 250, 251, 255, 257, 279, 282, 515, 516, 517; 141/129, 144, 145, 177; 221/263, 264, 265, 266; 222/370

[56] References Cited

U.S. PATENT DOCUMENTS

| | | | |
|---|---|---|---|
| 1,884,365 | 10/1932 | Suppiger et al. | 221/265 |
| 2,558,028 | 6/1951 | Winters | 53/238 X |
| 2,861,610 | 11/1958 | Ramsay | 53/517 X |
| 3,028,713 | 4/1962 | Kennedy et al. | 53/247 X |
| 3,628,694 | 12/1971 | Nichols | 221/265 |
| 3,925,960 | 12/1975 | Saari et al. | 53/240 X |
| 4,646,509 | 3/1987 | Triberg | 53/515 X |

*Primary Examiner*—John Sipos
*Assistant Examiner*—Beth Bianca
*Attorney, Agent, or Firm*—Flehr, Hohbach, Test, Albritton & Herbert

[57] ABSTRACT

Apparatus for depositing discrete articles such as pieces of fruit for a fruit cocktail in a continuously moving line of containers including a circular receptacle having a bottom and a confining rim, the bottom being formed with circular openings adjacent the rim, a plate underlying the receptacle which is imperforate except for a hole in a delivery position and on the circle of said openings to release one or more of such articles to a container, and container transport means including a helical transport underlying the receptacle and moving the containers in a straight line such that each container aligns with the hole in the plate and an opening in the receptacle for receiving one or more articles. Such apparatus preferably is modular with driving means for the receptacle and driving means for the containers which are connectable to and disconnectable from like driving means of other modules. Preferably also a means is provided to adjust the level of the receptacle during operation of the apparatus.

7 Claims, 4 Drawing Sheets

COCKTAIL FILLING APPARATUS

This invention relates to apparatus for filling containers with solid pieces of food, for example with a mixture of solid fruits to provide fruit cocktails. It will be apparent that the apparatus is applicable to the programmed, repetitive delivery of other discrete articles but it will be described with reference to fillers for fruit cocktail containers.

Equipment heretofore available for this purpose includes apparatus which comprises a circular container, receptacle (or as it is called) a "bowl," such having a bottom and a confining rim, the bottom being imperforate except for holes adjacent the rim lying on a circle centered on the axis of the bowl. This bowl is supplied in its central portion with the pieces of fruit which are swept outwardly toward the side wall or rim. The path of containers beneath the bowl is serpentine in shape and a tripgate mechanism is provided to drop pieces of fruit into the containers. The mechanism has caused breakdowns. Further the equipment has been time consuming to clean requiring, for example, an hour or more after each shift to clean.

Such apparatus is rather complicated in its construction and operation; it is difficult to adjust for different quantities of fruit, for example two cherries or three; its capacity is fixed and is not easily changed for different requirements, for example to expand a line from four ingredients to five or to shrink it from four to three; and it is difficult to clean.

It is an object of the present invention to provide a filler which is modular and which can be increased or diminished in size according to requirements; which avoids the disadvantages of a curved serpentine path for the containers; and which is readily adjusted for different quantities of food particles to be deposited by each bowl.

It is an object of the present invention to provide improved filling equipment for filling containers with discrete solid particles, e.g. pieces of fruit.

It is a particular object of the invention to provide such apparatus which is modular and can be easily expanded or contracted when desired or necessary.

Another object is to diminish the complexity of such apparatus and to provide means for rapidly adjusting the quantities of particles of fruit delivered to a container, for example to shift from three Maracchino cherries to two or to increase the quantity from three to four per container.

The above and other objects of the invention will be apparent from the ensuing description and the appended claims.

One embodiment of the invention is shown by way of example in the accompanying drawings, in which.

Figure 1:
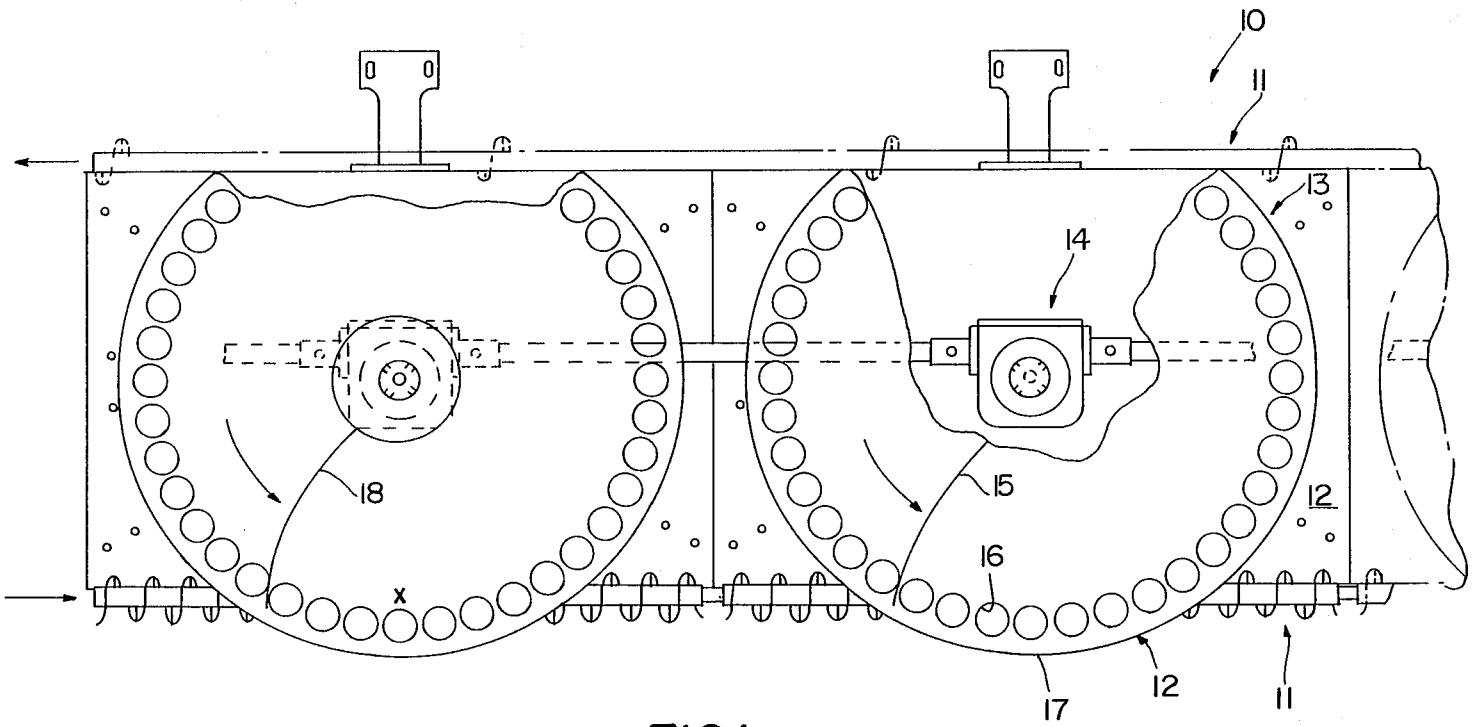
FIG. 1 is a top plan view of the equipment of the invention showing by way of example three modules.
Figure 2:
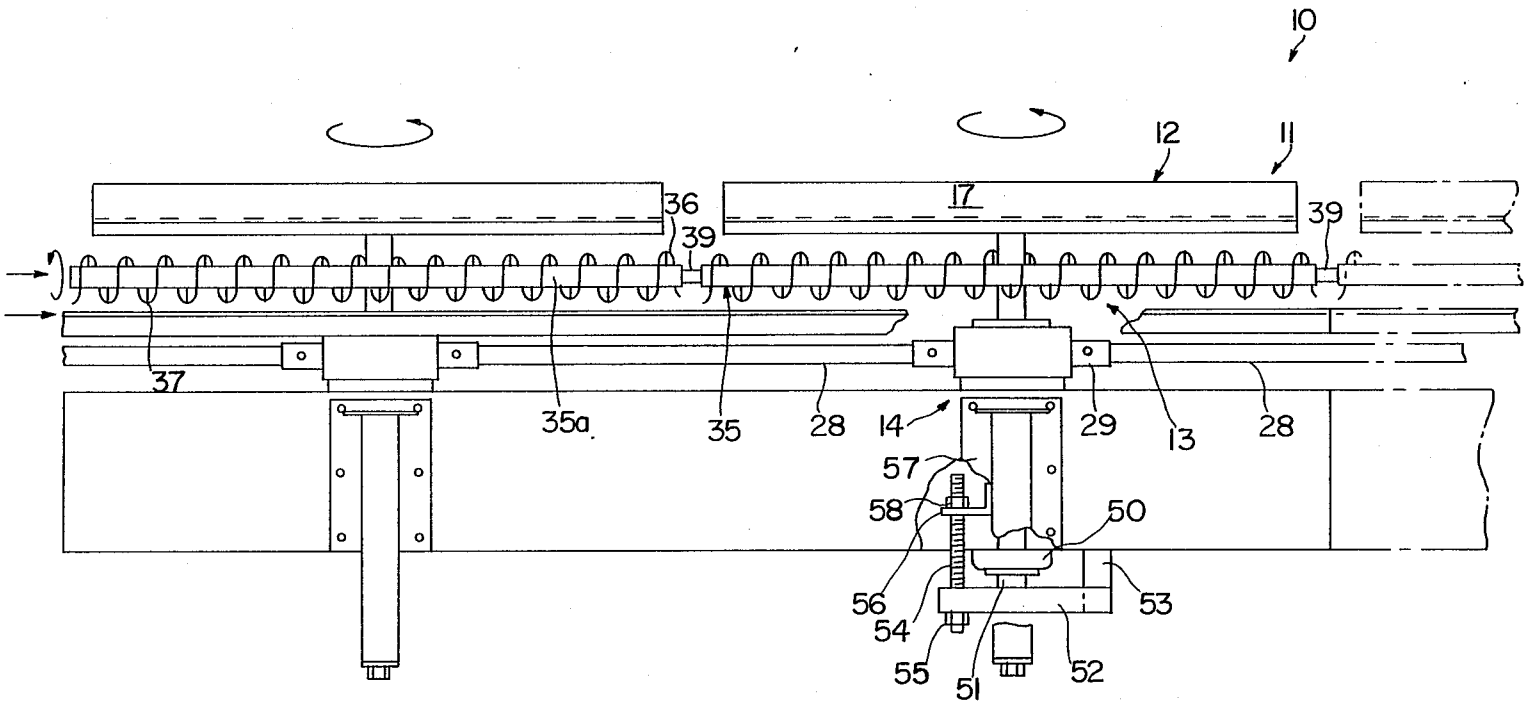
FIG. 2 is a side elevation of the apparatus of FIG. 1.

Referring now to FIGS. 1 and 2, the equipment is generally designated by the reference numeral 10 and it comprises a number (3 in the example shown) of identical modules 11, each comprising a bowl 12, a container feed 13 and a bowl drive 14.

The bowl is an open receptacle having a bottom 15 with circular holes 16 adjacent a confining rim 17 and centered on the center of the bowl. Above the bowl is a wiping arm 18 which is stationary, is supported from above by suitable means (not shown) and is curved to sweep the pieces of fruit (which are delivered near the center of the bowl) radially outwardly toward the circle of holes 16. Beneath the bowl and spaced from it is a plate 19 which is stationary and is imperforate except for a hole 20. A tubular sleeve 25 is slidably held in each hole 16, being held therein by a rim 26.

Each bowl 12 is supported by and is rotated by a vertical shaft 27 which is part of the drive assembly 14. The drive assembly comprises a horizontal shaft 28 coming from the right as viewed in FIG. 2 and which is detachably connected by a coupling 29 to a speed reducer and gear box 30. The gear box 30 is of known conventional design except that it has a output shaft 28 to the left as viewed in FIG. 2 (together with a coupling 29) which constitutes the input shaft for the next identical module. The vertical bowl drive shaft 27 is driven by the shaft 28 through gear box 30 and is slidable through the gear box for height adjustment by means described hereinafter.

The container drive and timing device 13 comprises a shaft 35 around which is coiled a stout wire helix 36, the turns of which are supported on and spaced from the shaft by rods 37 welded or otherwise fixed to the helix 36 and shaft 35. The shaft 35 is constructed in segments 35*a* which are detachably connected by connecting members 39 which are force fitted or threaded into the ends of the segments 35*a*.

Figure 3:
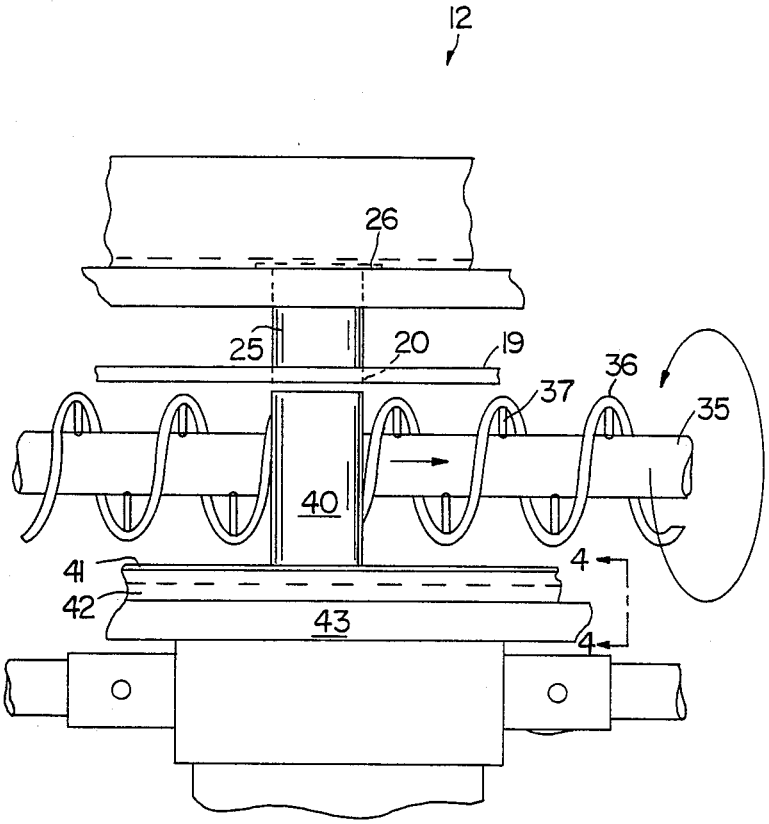
FIG. 3 is a detailed view in side elevation showing the means for moving the containers and for adjusting the quantity of fruit pieces to be deposited in each container from a single bowl.
Figure 4:
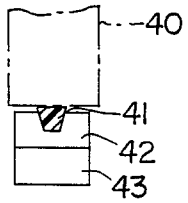
FIG. 4 is a view partly in vertical section along the line 4—4 of FIG. 3.

Referring now to FIGS. 3 and 4, a container, for example a cylindrical metal can, is shown at 40 supported on an endless flat top belt 41 made of hard rubber or plastic material and supported in belt member 42, which is supported by and slides on a frame member 43.

A guard rail (not shown) provides side support for the containers and holds them against the shaft 35 and between the turns of the helix 36.

Each bowl 12, each shaft segment 35*a* and the endless belt 41 are driven in synchronism so that each container 40 reaches the point marked "X" in each module after the preceding container has left that position and as a hole 16 in the bowl 12 reaches the position "X".

Referring now to FIG. 2, a height adjustment for the bowl 12 is shown. The shaft 27 which supports and rotates the bowl 12 is journalled at its lower end in a bearing 50 which rests upon a boss 51 on a lifting arm 52, one end of which (the righthand end as viewed in FIG. 2) pivots in a bracket 53 fixed to the frame of the machine. A threaded rod 54 is fixed by a nut 55 to the other end of the arm 52 and near the upper end the rod 54 passes through a bracket 56 fixed to a leg 57 which is fixed to the frame of the machine. A nut 58 is threaded onto the rod 54. By turning the nut 58 one way or the other, the arm 52, and with it the shaft 27 and bowl 12 are lifted and lowered.

Referring to FIG. 3, if the bowl 12 is lifted it increases the gap between the lower end of sleeve 25 and plate 19, thus allowing a greater quantity of pieces of fruit to be accommodated and a greater quantity will be deposited in each container. If the bowl is lowered, the quantity will be diminished. If small pieces, e.g. grains of corn, are being deposited, a sleeve (not shown) slideable over sleeve 25 my be used, as in standard practice, which rides on plate 19 and prevents loss of product through the gap.

A sleeve 25 is shown in FIG. 3 but, for convenience is not in the other figures. It will be understood that there is a sleeve 25 in each hole 16.

As shown in FIG. 2, the legs 57 are each provided at their lower ends with horizontal feet 58 and screws 59 are threaded into the feet 58. By turning the screws, the several legs may be adjusted to level of the machine.

Figure 5:
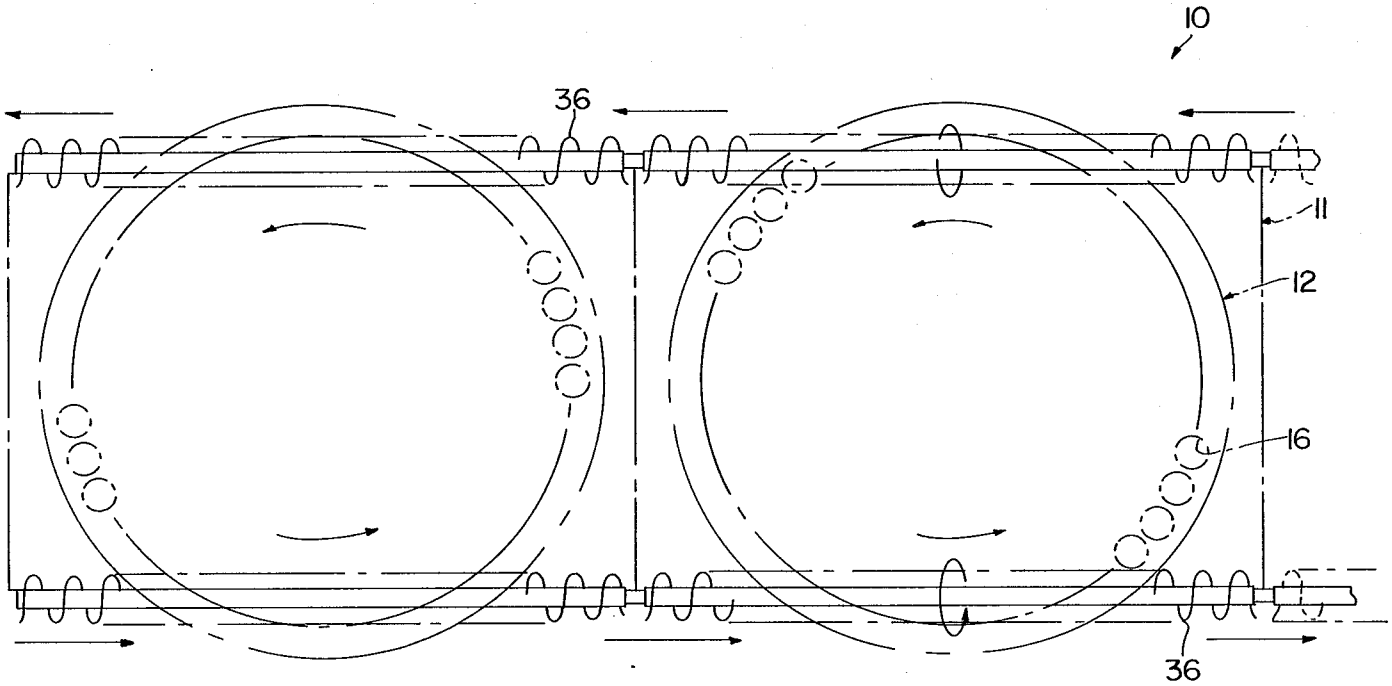
FIG. 5 is a diagrammatic top plan view of a of the apparatus of FIGS. 1 to 4 illustrating how it can be modified to double its capacity.

Referring now to FIG. 5, this figure illustrates another advantage of the machine. Two modules 11 are shown each with a bowl 12 and two helical feed screws one on each side of the machine. The lower feed screw (i.e. lower as viewed in FIG. 5) moves from left to right and the other feed screw moves from right to left. The capacity of the machine is thus doubled.

Another advantage of the machine is that two machines such as shown in FIGS. 1 and 2 can be operated in the same direction (i.e. with the bowls 12 rotating clockwise in one machine and the bowls 12 rotating counterclockwise in the other machine) with a platform between them. Thus an operator may stand on the platform and monitor two lines. Yet another advantage is the much greater case of cleaning the apparatus as compared to the difficulty of cleaning the apparatus of the prior art. It is customary to clean the apparatus at the end of each shift. Because of the complicated nature of the prior apparatus it is much more difficult and time consuming to clean it. The apparatus of the present invention can be cleaned quickly and easily.

It will thus be apparent that a novel and useful filling apparatus has been provided.

We claim:

1. A modular apparatus for depositing discrete articles into a continuously moving line of containers, said apparatus comprising at least two modules, each such module comprising:

(a) a cylindrical receptacle having a bottom and a confining side wall, the bottom having formed in it adjacent the confining wall a multiplicity of holes arranged in a circle concentric to the receptacle (b) means for rotating the receptacle (a) about its cylinder axis to bring each hole, in its turn, to a delivery position, said means including a receptacle drive shaft supporting said receptacle (a) for such rotary motion, (c) a stationary plate underlying the receptacle (a) and which is imperforate except for a hole at said delivery position (d) a horizontal container transport shaft beneath said receptacle and helical means carried by such shaft to cradle containers and move them continuously in a line underlying said receptacle (a), said container transport shaft of each module being connectable to and disconnectable from the container transport shaft of an adjacent module or modules and (e) a receptacle drive beneath said receptacle in the form of a horizontal shaft, a gear assembly having input means for connecting to said horizontal shaft and having a first output means connectable to the horizontal input shaft of an adjacent module and a second output means connected to said receptacle drive shaft whereby a number of such modules may be connected in tandem for continuously delivering an assortment of discrete articles to a continuously moving line of containers and a module may be added or subtracted from the apparatus at will.

2. The modular assembly of claim 1 wherein the container transport (d) includes a horizontal flat top endless belt underlying and supporting containers as they move.

3. The modular assembly of claim 1 including sleeves located in the holes of the receptacle and which project below the bottom of the receptacle and means for adjusting the level of the receptacle to adjust the number of discrete articles deposited in each container.

4. The modular assembly of claim 3 wherein such adjustment means permits adjustment while the machine is operating.

5. The assembly of claim 4 wherein the adjustment means is in the form of a lifting arm underlying and supporting the receptacle drive shaft and means for raising and lowering the arm and with it the receptacle shaft and the receptacle.

6. The assembly of claim 5 wherein such adjustment means includes a threaded rod supported by and movable vertically in relation to a stationary part of the assembly and connected to said lifting arm and means for turning the threaded rod to move the lifting arm up or down.

7. The apparatus of claim 1 wherein said means (b) rotates the receptacle (a) to a first delivery position and to a second delivery position 180° from the first delivery position, said plate (c) has a hole at each said delivery position and there are transporting means (d) on opposite sides of the receptacle for transporting two lines of articles in opposite directions.

* * * * *